US009731326B2

(12) United States Patent
Günther

(10) Patent No.: US 9,731,326 B2
(45) Date of Patent: Aug. 15, 2017

(54) SCREEN DEVICE COMPRISING SCREEN ROLLERS FOR PREVENTING OVERSIZE GRAIN FROM JAMMING

(71) Applicant: Günther Holding GmbH & Co. KG, Wartenberg (DE)

(72) Inventor: Bernhard Günther, Wartenberg (DE)

(73) Assignee: GÜNTHER HOLDING GMBH & CO. KG, Wartenberg (DE)

( * ) Notice: Subject to any disclaimer, the term of this patent is extended or adjusted under 35 U.S.C. 154(b) by 0 days.

(21) Appl. No.: 14/933,418

(22) Filed: Nov. 5, 2015

(65) Prior Publication Data

US 2016/0129476 A1 May 12, 2016

(30) Foreign Application Priority Data

Nov. 7, 2014 (DE) ..... 20 2014 105 361 U

(51) Int. Cl.
*B07B 13/00* (2006.01)
*B07B 1/14* (2006.01)
*B07B 1/15* (2006.01)

(52) U.S. Cl.
CPC ..... *B07B 1/14* (2013.01); *B07B 1/145* (2013.01); *B07B 1/15* (2013.01)

(58) Field of Classification Search
CPC ..... B07B 1/14; B07B 1/15; B07B 1/145
(Continued)

(56) References Cited

U.S. PATENT DOCUMENTS 1,766,340 A 6/1930 Kendall
2,124,856 A * 7/1938 Kohler ..... B07B 1/15 209/628

(Continued)

FOREIGN PATENT DOCUMENTS

DE 17 82 501 B1 3/1973
EP 1 183 930 3/2002

(Continued)

OTHER PUBLICATIONS

European Search Report dated Mar. 7, 2016.

*Primary Examiner* — Terrell Matthews
(74) *Attorney, Agent, or Firm* — Massina Pat. & TM Law, PLLC

(57) ABSTRACT

A screen device for sorting screening material into one or more fine grain fractions and one or more oversize grain fractions. The screen device includes a frame and a roller screen including screen rollers which are arranged, such that they can be rotary-driven about a roller axis each, next to each other and which are supported on the frame and which each comprise a roller body and one or more screen structures which protrude radially relative to the roller body. There is a fine grain screen gap between the roller bodies of respectively adjacent screen rollers, through which a fine grain fraction falls, while an oversize grain fraction is conveyed on the roller screen in the axial direction of the rollers when the screen rollers are rotary-driven. The roller body of at least one of the screen rollers widens radially in the axial direction of the rollers in an axial widening portion and the width of the fine grain screen gap which the widening roller body forms with the roller body of an adjacent screen roller decreases in the axial direction of the rollers along the widening portion.

27 Claims, 5 Drawing Sheets

(58) Field of Classification Search
USPC ..... 209/671, 673
See application file for complete search history.

(56) References Cited

U.S. PATENT DOCUMENTS

| | | | | |
|---|---|---|---|---|
| 5,012,933 | A * | 5/1991 | Artiano | D21B 1/023 209/671 |
| 7,445,122 | B2 * | 11/2008 | Currey | B07B 1/15 209/671 |
| 8,191,714 | B2 * | 6/2012 | Kalverkamp | A01D 17/06 171/133 |
| 8,720,695 | B2 * | 5/2014 | Greve | B07B 1/14 209/240 |
| 2006/0180523 | A1 * | 8/2006 | Smith | B07B 1/15 209/667 |
| 2011/0094944 | A1 * | 4/2011 | Bruggencate | B07B 1/15 209/351 |

FOREIGN PATENT DOCUMENTS

| | | | |
|---|---|---|---|
| FR | 2 558 392 | A3 | 7/1985 |
| GB | 280 191 | A | 5/1928 |
| JP | 08267011 | A * | 10/1996 |

* cited by examiner

SCREEN DEVICE COMPRISING SCREEN ROLLERS FOR PREVENTING OVERSIZE GRAIN FROM JAMMING

This application claims priority to German Utility Model No. 20 2014 105 361.1 filed on Nov. 7, 2014, the contents of which are incorporated herein by reference.

FIELD OF THE INVENTION

The invention relates to a screen device comprising screen rollers which are arranged, such that they can be rotary-driven, next to each other on a frame in order to form a roller screen for sorting screening material into one or more fine grain fractions and one or more oversize grain fractions. The screen rollers are designed to convey at least some of an oversize grain fraction in the axial direction of the rollers. The invention also relates to a screen roller itself which is suitable for forming such a screen device.

BACKGROUND OF THE INVENTION

A screen device of the type mentioned is known for example from EP 1 570 919 B1. This screen device comprises a roller screen comprising interlocking helical or spiral rollers which are arranged, such that they can be rotary-driven, next to each other. A screening material introduced onto the roller screen is separated into a fine grain fraction which falls down between said screen rollers, a first oversize grain fraction which is conveyed on the screen rollers transverse to the axial direction of the rollers, and a second oversize grain fraction which is conveyed in the axial direction of the rollers by the screw action of the screen rollers. The first oversize grain fraction is discharged transverse to the axial direction of the rollers at one end of the roller screen. The screen rollers are mounted at one end only and therefore overhung, such that the second oversize grain fraction can be discharged without hindrance at the freely projecting end of the screen rollers.

EP 2 329 891 B1 describes another example of a screen device. Instead of helical or spiral rollers, the screen device comprises screen rollers comprising screen discs which are arranged in parallel next to each other in the axial direction of the rollers and together form a disc screen. In order to still convey some of the oversize grain fraction in the axial direction of the rollers, the screen rollers of the disc screen are arranged such that the roller axes are inclined obliquely downwards from an introducing region of the disc screen towards an output region. The relevant oversize grain fraction is therefore conveyed in the axial direction of the rollers by gravity. Unlike the first screen device mentioned, the screen rollers of the disc screen are mounted on both sides, such that measures have to be taken so as not to excessively obstruct the removal of the relevant oversize grain fraction past the axial ends of the screen rollers.

SUMMARY OF THE INVENTION

It is an object of the invention to reduce the risk, in a roller screen on which an oversize grain fraction is conveyed in the axial direction of the rollers, of some of said oversize grain fraction jamming, in particular in embodiments in which screen rollers of the roller screen are mounted on both sides. Another object is to provide a screen roller which counters the risk of jamming from oversize grain conveyed in the axial direction of the rollers, when it is installed in a roller screen and in particular mounted on both sides.

The invention is based on a screen device for sorting screening material into one or more fine grain fractions and one or more oversize grain fractions, said device comprising a frame and a roller screen comprising screen rollers which are arranged, such that they can rotate about a roller axis each, next to each other and which are supported on the frame. The screen rollers each comprise a roller body and one or more screen structures which protrude radially relative to the roller body. The screen rollers are embodied and arranged such that there is a fine grain screen gap between the roller bodies of respectively adjacent screen rollers, through which a fine grain fraction falls, while an oversize grain fraction is conveyed on the roller screen in the axial direction of the rollers when the screen rollers are rotary-driven.

The one or more radially protruding screen structures of the respective screen roller can be screen discs, in particular screen stars comprising radially projecting fingers. Screen discs of this type are known for example from EP 1 088 599 B1. The projecting fingers of the individual screen stars can advantageously be elastically flexible, as is described in this document; in principle, however, the screen stars can also be inflexible in and of themselves or can exhibit an elasticity which is negligible in practice during operations. In order to convey an oversize grain fraction in the axial direction of the rollers, the screen discs of the screen rollers of a disc screen can be arranged such that they are inclined in relation to the respective roller axis, i.e. exhibit an inclination of more than 0° and less than 90° with respect to the respective roller axis in a plan view onto the roller screen, in order to convey the relevant oversize grain fraction in the axial direction of the rollers by screw action. Instead of screen stars, it is also possible to use simple circular or oval or similarly shaped screen discs. The screen discs of any type can also in principle be arranged orthogonally with respect to the respective roller axis. In embodiments comprising only orthogonally aligned screen discs or other types of screen structure, the screen rollers are inclined downwards in the axial direction of the rollers in which the relevant oversize grain fraction is to be conveyed, in order for it to be conveyed by gravity.

In preferred embodiments, however, the screen rollers or at least some of the screen rollers of the roller screen are helical or spiral rollers and each comprise a screen structure which radially protrudes from the roller body, in the form of a winding structure which helically encircles the roller axis. In such embodiments, two or also as applicable even more helically encircling screen structures can encircle the same roller body and collectively form a multi-threaded screen structure of the respective screen roller. Expediently, however, the screen rollers each exhibit only one helically encircling screen structure, i.e. they are single-threaded. A screen structure formed as a winding structure advantageously encircles the relevant roller axis continuously, such that its profile is continuously differentiable, to put it in mathematical terms, over the entire axial length or at least the vast majority of the length of the screen structure.

The one or more screen structures of adjacent screen rollers, which protrude radially in relation to the respective roller body, advantageously interlock as viewed in a plan view onto the roller screen. As viewed in a plan view, the screen structures therefore protrude into the fine grain screen gaps formed between respectively adjacent roller bodies, through which the fine grain falls, and a protruding screen structure or protruding screen structure portion of one screen roller is respectively followed in the axial direction of the rollers by a protruding screen structure or protruding screen structure portion of an adjacent screen roller. It would however also in principle be possible to not arrange the screen structures of adjacent screen rollers "staggered" in the axial direction of the rollers, such that they interlock and mesh, but rather to embody them such that they are axially level and therefore directly face each other in the transverse direction. If screen structures of adjacent screen rollers interlock, however, this creates design clearances in terms of the configuration of the "mesh size" of the roller screen in addition to dimensioning the gap width between the roller bodies.

In accordance with the invention, the roller body of at least one of the screen rollers widens radially in the axial direction of the rollers in an axial widening portion, such that the width of the fine grain screen gap which the widening roller body forms with the roller body of an adjacent screen roller decreases in the axial direction of the rollers in the widening portion, wherein the axial direction of the rollers is the direction in which the relevant oversize grain fraction is conveyed to the widening portion. While elongated and light parts of the oversize grain fraction are primarily conveyed transverse to the axial direction of the rollers, the oversize grain fraction conveyed in the axial direction of the rollers mainly includes parts or lumps which in terms of their outer dimensions are compact and heavy. If the screening material is for example excavated earth or rubble, the oversize grain fraction conveyed in the axial direction of the rollers contains agglomerating clumps of earth and/or large rocks which do not fall downwards through the roller screen but are instead, due to their dimensions and weight, conveyed in the axial direction of the rollers in the depressions formed between adjacent screen rollers. This oversize grain fraction is buoyed upwards in the widening portion, i.e. by the roller body widening in said portion, since the relevant parts can protrude less deeply into the fine grain screen gap which narrows because of said widening. The depression which is formed, together with an adjacent roller body, over the fine grain screen gap becomes flatter and the conveying effect of the screen roller in the circumferential direction, transverse to the axial direction of the rollers, becomes stronger. If the one or more protruding screen structures exhibit an inclination relative to the axial direction of the rollers and therefore exert a conveying effect on the oversize grain in the axial direction of the rollers, this axial conveying effect is by contrast weakened along the widening portion.

Because even compact oversize grain is transversely conveyed more intensely in the region of the widenings and the risk of jamming is accordingly reduced, the screen rollers in a roller screen comprising widening screen rollers can be mounted at both ends, which benefits the stability and robustness of the screen device. A frame wall can limit the roller screen at the downward ends of the screen rollers, which provides advantages in many applications or facilitates the installation of the roller screen.

The widening portion of the screen roller can also comprise one or more screen structures which protrude radially in relation to the roller body, for example one or more screen discs or preferably a portion of a helically encircling, i.e. winding screen structure. A winding screen structure can in principle extend up to an axial end of the widening portion in the axial direction of the rollers, or a screen disc can be arranged at said end. In preferred embodiments, however, the extent of radial protrusion—the height—of the one or more screen structures decreases in the widening portion, i.e. the one or more screen structures flatten out in the axial direction of the rollers in the widening portion. If one imagines an envelope—a virtual envelope—placed against the outer circumference of the one or more screen structures, then in the preferred embodiments, said envelope tapers in the axial direction of the rollers in the widening portion. The radial height of the flanks via which the one or more screen structures exert a conveying effect in the axial direction of the rollers, if it/they is/are inclined with respect to the axial direction of the rollers, thus decreases not only because the roller body widens but also because the one or more screen structures radially flatten out. The buoying effect already achieved by the roller body widening is intensified, and any axial conveying effect is further weakened.

The widening portion of the roller body can in particular widen conically. Instead of widening at a constant widening angle, the widening portion of the roller body can also widen in the shape of a trumpet, i.e. at an increasing widening angle and therefore progressively, or also in the shape of a bell, i.e. at a decreasing widening angle or regressively. Although widening can be discontinuous, in stages, and then preferably in multiple small stages, preferred embodiments are those in which the widening portion of the roller body widens gradually and continuously—in a continuously differentiable way and preferably monotonically, to put it in mathematical terms. The widening extends over a portion length which in preferred embodiments is larger, preferably at least two and more preferably at least five times larger, than the gap width of the fine grain screen gap which the roller body forms with an adjacent roller body of the roller screen in front of the widening portion in the axial direction of the rollers.

The widening portion of the roller body widens to a maximum width. The maximum width is preferably at most as large as a maximum radial width of the one or more screen structures which is/are arranged in front of the widening portion in relation to the axial direction of the rollers. More preferably, the maximum radial width which the widening portion of the roller body exhibits is smaller than the maximum radial width of the outer circumference of said one or more screen structures which is/are upward in relation to the axial direction of the rollers. The one or more upward screen structures preferably exhibit a constant width over the length of an upward roller body portion which the widening portion adjoins in the axial direction of the rollers, such that the envelope mentioned is cylindrical in the upward roller body portion.

The widening portion of the roller body can widen continuously from an initial width to a maximum radial width, i.e. can for example be conical, trumpet-shaped or bell-shaped with a monotonically increasing width, over the entire axial length of the widening portion. In preferred embodiments, however, the widening portion comprises a first sub-portion and, immediately adjoining it axially, a second sub-portion. In the first axial sub-portion, the roller body widens—preferably as already described—until it exhibits a maximum radial width at one axial end of the first sub-portion. Preferably, the radial width in the second sub-portion is at least substantially constant, wherein the radial width of the second sub-portion can in particular correspond to the maximum radial width of the first sub-portion. In the second sub-portion, the roller body is preferably at least substantially cylindrical. A cylindrical second sub-portion can in particular be circularly cylindrical.

In preferred embodiments, the widening portion of the roller body comprises a transverse conveying structure or a reverse conveying structure, which also includes a combined transverse and reverse conveying structure. Due to widening and the buoying caused by it, the conveying effect exerted transverse to the axial direction of the rollers on the oversize grain which passes into the widening portion is by its very nature intensified as compared to the roller body in front of the widening portion. A transverse conveying structure further intensifies this transverse conveying effect in the widening portion. The transverse conveying structure can in particular be formed as surface structuring, for example knurling or fluting, or an outer denticulation or ribbed structure with protruding, axially extending teeth or ribs. The conveying structure can be further developed into a transverse and reverse conveying structure in order to be able to exert not only an intensified conveying effect in the circumferential direction of the screen roller, but also counter to the axial direction of the rollers, on the oversize grain which passes into the widening portion. A transverse and reverse conveying structure can likewise be advantageously formed in the manner of an outer denticulation or ribbed structure comprising teeth or ribs which exhibit an inclination of more than 0° and less than 90° in relation to the roller axis. The transverse and reverse conveying structure can thus for example be formed by an oblique denticulation or by a ribbed structure comprising ribs which extend obliquely on the circumference of the widening portion. If the widening portion of the roller body comprises the sub-portions already described, which differ from each other in terms of the widening, the transverse and/or reverse conveying structure is preferably provided in the second sub-portion and preferably only in the second sub-portion.

In first embodiments, the widening portion forms an axial conveying end of the screen roller, wherein the roller body preferably exhibits a maximum radial width at this conveying end. The axial conveying end is an end of the screen roller which it is not possible to axially convey beyond due to a limitation or at which oversize grain conveyed in the axial direction of the rollers leaves the roller screen and in particular can fall down from the roller screen between the screen rollers.

In preferred embodiments, the frame comprises a frame wall which limits the roller screen at one axial end of the screen rollers and protrudes beyond the upper side of the roller screen. The axial conveying ends of the screen rollers can axially face said frame wall. The roller screen therefore conveys the relevant oversize grain in the axial direction of the rollers towards the frame wall. If the oversize grain is conveyed in the axial direction of the rollers up to and against the frame wall, there is a risk of occlusion or jamming at the axial conveying end. In the first embodiments, this risk is countered by widening the roller body at the conveying end, since the oversize grain is buoyed upwards in the widening portion and is transversely conveyed more intensely in the widening portion due to the rotating roller body, which can be intensified by embodying the transverse and/or reverse conveying structure mentioned.

In a preferred variant of the first embodiments, the roller bodies of at least some of the screen rollers are attenuated at the axial end near the frame wall or terminate at a distance in front of the frame wall. The relevant screen rollers each comprise a slender roller portion immediately in front of the frame wall. The width of the gaps between adjacent screen rollers, obtained in the region of the slender roller portions, is larger than the width of the fine grain screen gap. This creates a peripheral strip at the ends of the screen rollers which are downward ends in relation to the axial direction of the rollers, wherein oversize grain conveyed up to and into the peripheral strip can fall down between adjacent screen rollers. The distance between the axial conveying end of the respective screen roller and the opposite facing frame wall is expediently at least as large as a breadth, as measured transverse to the axial direction of the rollers, of the oversize grain which is conveyed on the roller screen at least primarily in the axial direction of the rollers. The distance which the axial conveying end of the screen roller exhibits from the axially facing frame wall is preferably at least twice, more preferably at least three times as large as the width of the fine grain screen gap which the screen roller forms with the adjacent screen roller, upwards of the widening portion, for the fine grain fraction which falls through the roller screen. In the roller portion which is slender from the axial conveying end up to the facing frame wall, the screen roller exhibits a maximum radial width, which is preferably constant over the entire portion, and which in preferred embodiments is at most half as large as the radial width of the roller portion with which the screen roller forms the fine grain screen gap through which the fine grain fraction falls, upstream of the widening portion. Although one or even more than one screen roller of the roller screen can in principle extend immediately up to said frame wall over the full width of the respective roller body or its widening portion, it is preferred if all the screen rollers of the roller screen which extend axially up to the frame wall comprise a slender roller portion, such as has been described, in front of the frame wall, such that a peripheral strip which is continuous and uninterrupted in the transverse direction and in which the oversize grain fraction conveyed in the axial direction of the rollers can fall downwards is obtained immediately in front of the frame wall. A conveyance such as for example a conveyor belt, onto which the oversize grain fraction can fall and be removed, is preferably arranged below the peripheral strip.

In second embodiments, the roller body comprises a roller body portion which is axially upward in relation to the axial direction of the rollers, a roller body portion which is axially downward in relation to the axial direction of the rollers, and the widening portion axially between the upward and downward roller body portion. In the second embodiments, the widening does not form an axial conveying end of the roller body, but rather a middle portion. The length of the axially upward roller body portion can be exactly as large or substantially as large as the length of the axially downward roller body portion. The lengths of these two portions can however instead also be significantly different from each other. In the second embodiments, the screen roller can comprise one widening portion only or also, in further developments, an additional widening portion. In the additional widening portion, the roller body can in particular widen counter to the axial direction of the rollers. Embodiments in which the roller body also widens in the axial direction of the rollers in the additional widening portion are not however to be excluded. In particular in embodiments in which the roller body widens counter to the axial direction of the rollers in the additional widening portion, it is also preferred if the two widening portions adjoin each other, such that a widening and then a taper are obtained in the axial direction of the rollers. The widening portions preferably adjoin each other respectively at a maximum radial width. The statements made regarding the widening portion preferably apply similarly to the additional widening portion.

In the second embodiments in which the screen roller comprises the widening portion axially between an upward and a downward roller body portion, it is advantageous if the one or more protruding screen structures exhibit an inclination of more than 0° and less than 90° with respect to the axial direction of the rollers, in radial views onto the screen roller, and the inclination is positive in the upward roller body portion up to or up to and into the widening portion and negative in the downward roller body portion. When the screen roller is rotary-driven, the axially conveyed oversize grain fraction is conveyed towards the widening portion from each of two sides of the screen roller. When embodied for axially conveying in the opposite direction, the screen roller preferably comprises the additional widening portion which widens counter to the axial direction of the rollers, such that not only is the oversize grain fraction which is conveyed in the axial direction of the rollers to the widening portion buoyed upwards in the widening portion, but rather the oversize grain fraction which is conveyed counter to the axial direction of the rollers from the other side is also buoyed upwards in the additional widening portion and conveyed in the transverse direction in the region of the two widening portions. In principle, however, relief is also already provided when the screen roller is designed, over the entire length of the roller body, to convey in the axial direction of the rollers only, since in such embodiments, at least some of the axially conveyed oversize grain fraction is buoyed upwards in the widening portion, where it is conveyed transverse to the axial direction of the rollers, and only a residual portion of the oversize grain fraction is axially conveyed across the widening portion into the downward roller body portion.

In order to reduce forces acting on the respective screen roller due to screening material jamming, the roller body of at least one of the screen rollers, in particular the roller body which comprises the widening portion, can be mounted such that it can be axially moved, i.e. axially floats. Preferably, the relevant roller body can be moved axially, counter to the restoring force of an elastic element. This includes embodiments in which the relevant screen roller as a whole is mounted such that it can be axially moved and/or axially floats, and in particular embodiments in which the roller body is mounted, such that it axially floats, on a rotary-mounted shaft of the screen roller, for in preferred embodiments, the screen rollers each comprise a comparatively slender shaft which is rotatably mounted by the frame, preferably at both shaft ends, and a roller body which is joined to the shaft, fixedly in terms of torque and preferably non-rotationally. In such embodiments, the roller body is preferably mounted such that it can be axially moved relative to the shaft of the respective screen roller, for example by means of an elastic element at one axial end or an elastic element at each of the two axial ends of the roller body. The extent of axial mobility is typically in the range of up to a few millimeters; in many embodiments, the extent of axial mobility is between 1 and 3 mm. The elastic element can in particular be an elastomer element or an element made of natural rubber. In principle, however, a spring can also form the element.

In expedient embodiments, the roller screen comprises multiple screen rollers of the type in accordance with the invention. The statements made regarding the at least one screen roller apply similarly to each of these screen rollers. Thus, for example, every second screen roller as viewed in a plan view can be a screen roller of the type in accordance with the invention; more preferably, the roller screen comprises screen rollers of the type in accordance with the invention which are arranged immediately next to each other. Expediently, all or at least most of the screen rollers of the roller screen are embodied in accordance with the invention.

The roller body is expediently rotationally symmetrical, preferably including in the widening portion. In such embodiments, it comprises one or more circularly cylindrical roller body portions and one or more rotationally symmetrical widening portions. The roller body is advantageously a uniform rotary body which is rigid in its own right, i.e. it can be regarded as consisting of one piece. For practical reasons, however, it can be joined from multiple roller body portions, for example from one or more cylindrical roller body portions and one or more widening portions.

The screen rollers can be arranged horizontally level next to each other, such that the roller screen as a whole forms a horizontal plane. In modifications, the roller screen can slope upwards or downwards, such that it is inclined obliquely at a constant pitch or gradient or is otherwise inclined in the transverse conveying direction, by correspondingly arranging two or more of the screen rollers at different levels next to each other. The roller screen as a whole can also form a depression, by arranging one or more screen rollers which are situated on the sides of the roller screen in relation to the transverse conveying direction higher than one or more screen rollers in the middle of the screen. In another modification, the screen rollers can be arranged such that they are inclined in the axial direction of the rollers, preferably such that they rise in the axial direction of the rollers. This likewise reduces the risk of jamming when the compact oversize grain is conveyed in the axial direction of the rollers and counter to the force of gravity. Agglomerating materials, such as muddy excavated earth, are also loosened, since the clumps experience more jolts due to gravity and also remain on the roller screen for longer.

The invention does not however relate only to the screen device comprising the roller screen but also to a screen roller of the type in accordance with the invention itself. The screen roller in accordance with the invention comprises: a roller body comprising an outer roller body circumference; a bearing journal, for rotary-mounting the roller body about a roller axis, on at least one axial end; and one or more screen structures which are connected to the roller body, such that torque is transmitted and preferably non-rotationally, and protrude radially from the roller body circumference. As already described, the one or more screen structures of the screen roller can be one or more winding structure(s) which helically encircle(s) the roller body circumference, or multiple screen discs, for example screen stars, which are axially spaced from each other. In accordance with the invention, the roller body circumference widens radially in the axial direction of the rollers in an axial widening portion. Wherever a screen roller has been described above solely in connection with the screen device, the statements made regarding the screen roller of the screen device apply similarly to the screen roller in accordance with the invention itself, at least wherever features of the screen roller itself are concerned.

Advantageous features are also described in the sub-claims and in the combinations of the sub-claims.

Features of the invention are also described in the aspects worded below. The aspects are worded in the manner of claims and can replace the same. Features disclosed in the aspects can also supplement and/or qualify the claims, illustrate alternatives with respect to the individual features and/or expand on features of the claims. Bracketed reference signs refer to an example embodiment illustrated below in figures. They do not restrict the features described in the aspects to their literal sense itself, but do conversely illustrate preferred ways of realizing the respective feature.

Aspect 1: A screen device for sorting screening material into one or more fine grain fractions and one or more oversize grain fractions, the screen device comprising: a frame (2, 3); and a roller screen (1) comprising screen rollers (20; 30) which are arranged, such that they can be rotary-driven about a roller axis (R) each, next to each other and which are supported on the frame (2, 3) and which each comprise a roller body (21; 31) and one or more screen structures (22; 32) which protrude radially relative to the roller body (21; 31), wherein there is a fine grain screen gap between the roller bodies (21; 31) of respectively adjacent screen rollers (20; 30), through which a fine grain fraction falls, while an oversize grain fraction is conveyed on the roller screen (1) in the axial direction of the rollers (X) when the screen rollers (20; 30) are rotary-driven, wherein the roller body (21; 31) of at least one of the screen rollers (20; 30) widens radially in the axial direction of the rollers (X) in an axial widening portion (25; 35), and the width (w) of the fine grain screen gap which the widening roller body (21; 31) forms with the roller body (21; 31) of an adjacent screen roller (20; 30) decreases in the axial direction of the rollers (X) along the widening portion (25; 35).

Aspect 2: The screen device according to the preceding aspect, wherein a virtual envelope (H) which is placed against the outer circumference of the one or more screen structures (22; 32) of the at least one screen roller (20; 30) comprising the widening portion (25; 35) tapers in the axial direction of the rollers (X) along the widening portion (25; 35).

Aspect 3: The screen device according to any one of the preceding aspects, wherein the widening portion (25; 35) of the screen roller (20; 30) also comprises one or more screen structures (22; 32) which protrude radially from the roller body (21; 31).

Aspect 4: The screen device according to any one of the preceding aspects, wherein the widening portion (25; 35) widens to a maximum width gradually, preferably monotonically and continuously, in the axial direction of the rollers (X) over a length (a) in a first sub-portion (26; 36) and, in a second sub-portion (27; 37) which adjoins the first sub-portion (26; 36) in the axial direction of the rollers (X), is at least substantially cylindrical and preferably exhibits the maximum width.

Aspect 5: The screen device according to the preceding aspect, wherein the widening length (a) is larger than the width (w) of the fine grain screen gap which the roller body (21; 31) forms with an adjacent screen roller (10; 20; 30) upwards of the widening portion (25; 35) in relation to the axial direction of the rollers (X).

Aspect 6: The screen device according to any one of the immediately preceding two aspects, wherein the widening length (a) measures at least several centimeters.

Aspect 7: The screen device according to any one of the preceding aspects, wherein the widening portion (25; 35) widens in the axial direction of the rollers (X) in a first sub-portion (26; 36), preferably monotonically and continuously and preferably to a maximum width and, in a second sub-portion (27; 37) which adjoins the first sub-portion (26; 36) in the axial direction of the rollers (X), exhibits a maximum width and is preferably at least substantially cylindrical, and wherein the one or more protruding screen structures (22; 32) extend(s) in the axial direction of the rollers (X) up to the second sub-portion (27; 37) at most and preferably into the first sub-portion (26; 36).

Aspect 8: The screen device according to any one of the preceding aspects, wherein the widening portion (25; 35) of the roller body (21; 31), preferably the second sub-portion (27; 37) according to any one of the directly preceding two aspects, comprises a transverse and/or reverse conveying structure (28; 38) on its outer circumference, preferably surface structuring or a toothed or ribbed structure comprising teeth or ribs which are axially linear or extend at an inclination with respect to the axial direction of the rollers (X), in order to exert a conveying effect, transverse to the axial direction of the rollers (X) and/or counter to the axial direction of the rollers (X), on oversize grain conveyed into the widening portion (25; 35).

Aspect 9: The screen device according to any one of the preceding aspects, wherein the widening portion (25; 35) of the roller body (21; 31) widens in a continuously differentiable way over a length (a) of at least several centimeters.

Aspect 10: The screen device according to any one of the preceding aspects, wherein the widening portion (25; 35) of the roller body (21; 31) widens conically, in the shape of a trumpet or in the shape of a bell over a length (a) of at least several centimeters.

Aspect 11: The screen device according to any one of the preceding aspects, wherein the one or more screen structures (22; 32) exhibit an inclination ($\alpha$) of more than 0° and less than 90° with respect to the axial direction of the rollers (X) in a plan view onto the roller screen (1), in order to convey at least some of the oversize grain fraction in the axial direction of the rollers (X) when the screen rollers (20; 30) are rotary-driven.

Aspect 12: The screen device according to any one of the preceding aspects, wherein the roller body (21; 31) which comprises the widening portion (25; 35) can be axially moved, preferably counter to the restoring force of an elastic element (15).

Aspect 13: The screen device according to any one of the preceding aspects, wherein an axially elastic element (15) is arranged on at least one of the side-faces of the roller body (21; 31) which comprises the widening portion (25; 35), and the roller body (21; 31) can be axially moved, counter to the restoring force of the elastic element (15).

Aspect 14: The screen device according to any one of the preceding aspects, wherein the screen rollers (20; 30) are rotatably mounted on the frame (2, 3) at both axial ends.

Aspect 15: The screen device according to any one of the preceding aspects, wherein a frame wall (3) protrudes beyond an upper side of the roller screen (1) at an end of the screen rollers (10; 20) which is a downward end in the axial direction of the rollers (X), and at least some of the roller bodies (11; 21) are attenuated at the ends facing the frame wall (3) or terminate at an axial distance in front of the frame wall (3), such that the screen rollers (10; 20) each comprise a slender roller portion (14) at the ends facing the frame wall (3), and the clear distance between respectively adjacent slender roller portions (14) is at least twice, preferably at least three times as large as a maximum width (w) of the fine grain screen gap between adjacent roller bodies (11; 21), such that the slender roller portions (14) form a peripheral strip (8) which extends transverse to the axial direction of the rollers (X) and adjoins the frame wall (3) and in which oversize grain conveyed up to and into the peripheral strip (8) can fall down between the screen rollers (10; 20).

Aspect 16: The screen device according to any one of the preceding aspects, wherein the roller body (31) comprises an additional widening portion (35') and widens in the additional widening portion (35'), either likewise in the axial direction of the rollers (X) or preferably counter to the axial direction of the rollers (X).

Aspect 17: The screen device according to the preceding aspect, wherein the widening portions (35, 35') collectively form a contiguous widening portion in which the roller body (31) widens in the axial direction of the rollers (X) and then tapers again.

Aspect 18: The screen device according to any one of the preceding aspects, wherein the widening portion (25) forms an axial conveying end of the at least one screen roller (20) and preferably exhibits a maximum width at the conveying end.

Aspect 19: The screen device according to any one of Aspects 1 to 17, wherein the roller body (31) comprises a roller body portion which is an upward roller body portion (31*a*) in relation to the axial direction of the rollers (X), a roller body portion which is a downward roller body portion (31*b*) in relation to the axial direction of the rollers (X), and the widening portion (35) axially between the upward and downward roller body portion.

Aspect 20: The screen device according to the preceding aspect, wherein the one or more protruding screen structures (32) of the at least one screen roller (20; 30) comprising the widening portion (25; 35) exhibit an inclination ($\alpha$) of more than 0° and less than 90° with respect to the axial direction of the rollers (X) in a plan view onto the roller screen (1), and the inclination ($\alpha$) is positive in the upward roller body portion (31*a*) up to or up to and into the widening portion (35) and negative in the downward roller body portion (31*b*) up to the widening portion (25; 35) at most and preferably up to or up to and into the additional widening portion (35') of Aspect 17, in order to convey at least a first portion of the oversize grain fraction in the axial direction of the rollers (X) and at least a second portion of the oversize grain fraction counter to the axial direction of the rollers (X) and to remove it transverse to the axial direction of the rollers (X) in the region of the widening portion (35), preferably in the region of the widening portions (35, 35') of Aspect 17.

Aspect 21: The screen device according to any one of the preceding aspects, wherein the roller screen (1) comprises multiple screen rollers (20; 30) which each correspond to at least one of the preceding aspects.

Aspect 22: The screen device according to any one of the preceding aspects, wherein at least every second screen roller (20; 30) in a plan view onto the roller screen (1) respectively corresponds to at least one of the preceding aspects.

Aspect 23: The screen device according to any one of the preceding aspects, wherein two or more screen rollers (20; 30) of the roller screen (1) which are arranged immediately next to each other in a plan view respectively correspond to at least one of the preceding aspects, and the widening portions (25; 35) of adjacent screen rollers (20; 30) are arranged next to each other and widen in the same direction, such that the width (w) of the fine grain screen gap between the adjacent widening portions (25; 35) is reduced from both sides, preferably symmetrically.

Aspect 24: The screen device according to any one of the immediately preceding three aspects, wherein the widening portions (25; 35, 35') of the screen rollers (20; 30) are arranged, preferably next to each other and level in the axial direction of the rollers (X), such that in a plan view onto the roller screen (1), they collectively form a linear strip of widening portions (25; 35, 35') which is oblique or preferably orthogonal with respect to the axial direction of the rollers (X).

Aspect 25: A screen device for sorting screening material into one or more fine grain fractions and one or more oversize grain fractions, preferably according to any one of the preceding aspects, the screen device comprising: a frame (2, 3) comprising a frame wall (3); and a roller screen (1) comprising screen rollers (20; 30) which are arranged, such that they can be rotary-driven about a roller axis (R) each, next to each other and which are supported on the frame (2, 3) and which each comprise a roller body (21; 31) and one or more screen structures (22; 32) which protrude radially relative to the roller body (21; 31), such that there is a fine grain screen gap between the roller bodies (21; 31) of respectively adjacent screen rollers (20; 30), through which a fine grain fraction falls, while at least one oversize grain fraction is conveyed on the roller screen (1) in the axial direction of the rollers (X) towards the frame wall (3) when the screen rollers (20; 30) are rotary-driven, wherein the screen rollers (20; 30) are rotatably mounted on the frame (2, 3) at both axial ends, and the frame wall (3) limits the roller screen (1) at an end which is a downward end in relation to the axial direction of the rollers (X), and protrudes beyond an upper side of the roller screen (1), such that oversize grain cannot be conveyed over the frame wall (3) in the axial direction of the rollers (X), and wherein at least some of the roller bodies (21) are attenuated at the upward ends or terminate at an axial distance in front of the frame wall (3), such that the screen rollers (10; 20) each comprise a slender roller portion (14) at the ends facing the frame wall (3), and the clear distance between respectively adjacent slender roller portions (14) is at least twice, preferably at least three times as large as a maximum width (w) of the fine grain screen gap between adjacent roller bodies (11; 21), such that the slender roller portions (14) form a peripheral strip (8) which extends transverse to the axial direction of the rollers (X) and adjoins the frame wall (3) and in which oversize grain conveyed up to and into the peripheral strip (8) can fall down between the screen rollers (10; 20).

A screen device in accordance with Aspect 25 can comprise one or more screen rollers which each comprise a widening portion of the type in accordance with the invention, in particular one or more screen rollers which each comprise a widening portion which widens in the axial direction of the rollers only, wherein the widening portion preferably forms the axial conveying end of the respective screen roller which is near the peripheral strip. Due to the peripheral strip which is used for removing material, however, the screen device in accordance with Aspect 25 is also advantageous in and of itself, without the widening aspect, in particular in applications in which the roller screen is enclosed by frame walls at both axial ends of the screen rollers.

Aspect 26: The screen device according to any one of the preceding aspects, wherein the one or more screen structures (22; 32) helically encircle the roller axis (R) of the respective screen roller (10; 20; 30).

Aspect 27: The screen device according to any one of the preceding aspects, wherein the one or more screen structures (22; 32) of adjacent screen rollers (10; 20; 30) are offset axially with respect to each other in a plan view onto the roller screen (1), and the protruding screen structures (12; 22; 32) of the respectively adjacent screen rollers (10; 20; 30) interlock in the plan view.

Aspect 28: A screen roller for a screen device for sorting screening material into a fine grain fraction and an oversize grain fraction, preferably for the screen device according to any one of the preceding aspects, the screen roller comprising: a roller body (21; 31) comprising an outer roller body circumference; a bearing journal (23; 33) for rotary-mounting the roller body (21; 31) about a roller axis (R); and one or more screen structures (22; 32) which is/are connected to the roller body (21; 31), such that torque is transmitted, and protrude(s) radially from the roller body circumference and is/are formed by a winding structure which helically encircles the roller body circumference or by multiple screen discs which are axially spaced from each other, wherein the roller body circumference widens radially in the axial direction of the rollers (X) in an axial widening portion (25; 35).

Aspect 29: The screen roller according to the preceding aspect, wherein the screen roller (20; 30) can comprise any feature which is described, in one of the aspects directed to the screen device, for the at least one screen roller (20; 30) comprising the widening portion (25; 35).

BRIEF DESCRIPTION OF THE DRAWINGS

Example embodiments of the invention are described below on the basis of figures. The features disclosed by the example embodiments, each individually and in any combination of features, advantageously develop the embodiments of the invention described above and in particular the subject-matter of the claims and the subject-matter of the aspects, respectively. There is shown:

DETAILED DESCRIPTION OF THE INVENTION

Figure 1:
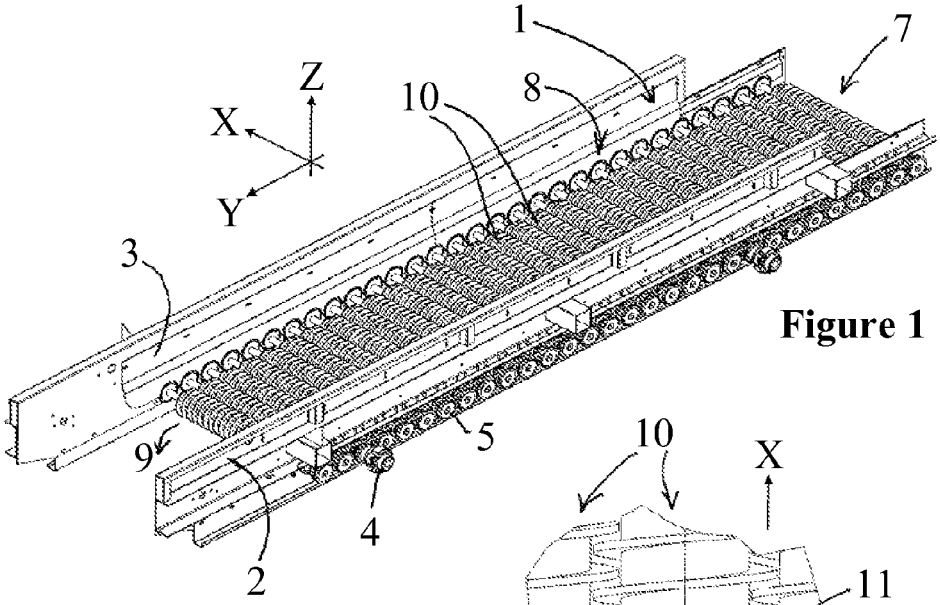
In FIG. 1, a screen device comprising screen rollers in a first example embodiment, is shown in an isometric representation.

FIG. 1 shows a screen device comprising a roller screen 1 consisting of screen rollers 10, in a first example embodiment. In order to form the roller screen 1, the screen rollers 10 are arranged next to each other and mounted at both roller ends in a frame of the screen device, such that they can rotate about a rotational axis each. The screen rollers 10 are each rotatably mounted at one roller end on a frame wall 2 and at the other roller end on a frame wall 3 and thus supported on both sides. The frame walls 2 and 3 protrude beyond an upper side of the roller screen 1 and enclose the roller screen 1 at the two roller ends. Together with the roller screen 1, they form a channel for a screening material which is to be sorted into different fractions by means of the screen device. The screen device also comprises a drive means for rotary-driving the screen rollers 10 in the same direction. In FIG. 1, only couplings 4 of the drive means, for attaching drive motors, and a traction drive for coupling the screen rollers 10, for rotary-driving them collectively in the same direction of rotation, can be seen. The traction drive comprises multiple traction mechanisms—in the example embodiment, chains—and drive wheels 5—in the example, toothed wheels—which are non-rotationally connected to the screen rollers 10. The traction mechanisms each enclose only the drive wheels of two adjacent screen rollers 10. The drive wheels 5 are correspondingly formed as twin-drive wheels, such that the screen rollers 10 driven via the traction mechanisms are each driven via one of the twin-drive wheels and output onto the next screen roller 10 via the other of the twin-drive wheels.

Figure 2:
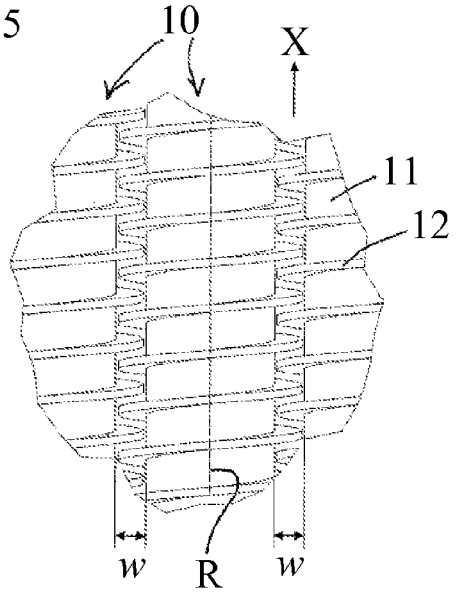
In FIG. 2, screen rollers arranged next to each other, are shown in a plan view.

FIG. 2 shows a small detail of the roller screen 1, in a plan view onto its upper side. The screen rollers 10 each comprise a roller body 11 and a screen structure 12 which is formed as a winding structure and encircles an outer circumferential surface of the roller body 11. Accordingly, the screen structure 12 protrudes radially from the roller body 11 of the respective screen roller 10 in the form of a helical line. When the screen rollers 10 are rotary-driven, their screen structures 12 exert a screw action and accordingly a conveying effect in the axial direction of the rollers X.

In the first example embodiment, the roller bodies 11 are each cylindrical over their entire length; they are preferably, but merely by way of example, circularly cylindrical over their entire length. A fine grain screen gap remains between the roller bodies 11 of respectively adjacent screen rollers 10 and exhibits a constant gap width w over the entire length of the roller bodies 11. The screen structures 12 of respectively adjacent screen rollers 10 extend axially offset with respect to each other in relation to the axial direction of the rollers X, such that the helical line of each respective screen roller 10 engages the flight of the screen structure of the respectively adjacent screen roller 10, i.e. the screen rollers 10 are embodied and arranged such that their screen structures 12 interlock. The rotational axis of one of the screen rollers 10 arranged in parallel is denoted by R in FIG. 2.

During sorting operations, a screening material which is introduced onto the upper side of the roller screen 1 in an introducing region 7 is separated into several different grain fractions. A fine grain fraction falls downwards through the screen gaps, preferably onto a conveying means, such as for example a conveyor belt, arranged below the roller screen 1 in order to remove the fine grain fraction from the region of the roller screen 1. The maximum grain size of the fine grain fraction is determined by the gap width w and the axial distances between the interlocking screen structures 12. The oversize grain which does not fall through the screen gaps is conveyed on the roller screen 1 by the screen rollers 10 which are rotary-driven in the same direction. The screen structures 12 of the screen rollers 10 exert a conveying effect in the axial direction of the rollers X and also a conveying effect in the transverse direction Y tangential to the outer circumferential surface of the roller bodies 11 on the oversize grain, wherein the oversize grain is separated into a first oversize grain fraction and a second oversize grain fraction. The first oversize grain fraction substantially contains compact, comparatively heavy parts which due to their outer dimensions protrude into the depressions formed over the respective screen gap between adjacent roller bodies 11, to such a depth that the flanks of the screen structures 12 can act on this oversize grain to an extent which is sufficient to convey the oversize grain in the depressions, or distributed among multiple consecutive depressions, in the axial direction of the rollers X into the peripheral region formed with the frame wall 3. A second oversize grain fraction, which in particular contains larger, for example elongated, and/or lighter parts, is conveyed primarily in the circumferential direction of the screen rollers 10, i.e. in the transverse direction Y, to an output region 9 situated at the end of the roller screen 1 which is the downward end in the transverse direction Y. In simple embodiments which not least for this reason are preferred embodiments, the second oversize grain fraction falls downwards from the roller screen 1 in the output region 9, preferably onto a remover, such as for example a conveyor belt, arranged below the roller screen 1 in the output region 9.

The roller screen 1 and the two frame walls 2 and 3 together form a conveying channel for the oversize grain. Problems can arise in particular in the peripheral region of the roller screen 1 near the frame wall 3, since the screen rollers 10 continually exert a conveying effect in the axial direction of the rollers X and therefore towards the frame wall 3 on the oversize grain. The first oversize grain fraction can accumulate in this peripheral region, which can jam screen rollers 10 and therefore interrupt sorting operations, or even damage the roller screen 1.

To counter the risk of jamming, the screen rollers 10 are attenuated in roller end portions near the frame wall 3, such that a peripheral strip 8 is obtained along the frame wall 3, in which the gap width w between respectively adjacent screen rollers 10 is significantly larger than in the other regions of the roller screen 1. The peripheral strip 8 can advantageously extend, as shown in FIG. 1, over the entire length of the roller screen 1 as measured in the transverse direction Y. The breadth of the peripheral strip 8 as measured in the axial direction of the rollers X can vary over the length of the roller screen 1. Expediently, however, the peripheral strip 8 exhibits a constant breadth. The slender roller portions of the screen rollers 10, which extend over the breadth of the peripheral strip 8, do not comprise any protruding screen structure, such that the screen rollers 10 do not exert any conveying effect in the axial direction of the rollers X in the peripheral strip 8. The screen rollers 10 can in particular each exhibit a smooth, non-structured outer circumference over the lengths of their slender roller portions. Optionally, the attenuated roller portions of individual screen rollers 10 or of each of the screen rollers 10 can comprise transverse conveying structures on their outer circumference, in order to be able to exert a conveying effect in the transverse direction Y on oversize grain conveyed into the peripheral strip 8.

Figure 3:
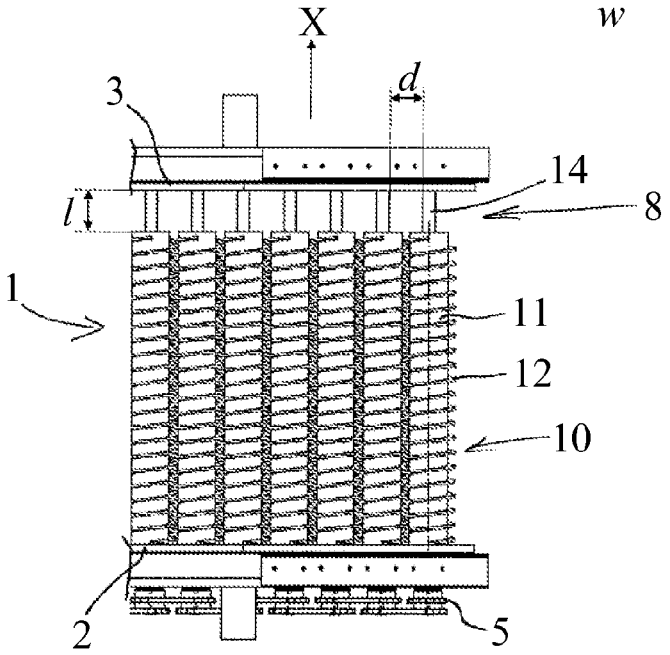
In FIG. 3, the screen device of the first example embodiment, is shown in a plan view.

FIG. 3 shows a part of the screen device, in a plan view onto the roller screen 1. A partial region of the peripheral strip 8, formed by slender roller end portions 14 of the screen rollers 10, can in particular be seen. The slender roller portions 14 are each smoothly cylindrical—in the example embodiment, circularly cylindrical—as is preferred but merely by way of example. The length l of the slender roller portions, as measured in the axial direction of the rollers X, corresponds to the breadth of the peripheral strip 8. A clear distance d remains between respectively adjacent roller portions 14. The distances d are larger than, and advantageously at least twice as large as, the width w of the screen gaps for the fine grain. The distances d are preferably at least three times and even more preferably at least five times as large as the gap width w. The lengths l of the slender roller portions 14 and therefore the breadth of the peripheral strip 8 are/is larger than, and advantageously at least twice as large as, the width w of the screen gaps for the fine grain and advantageously at least as large as the distance d. In simple embodiments which not least for this reason are preferred embodiments, the distances d and also the lengths l are constant over the entire peripheral strip 8. The distances d and/or the lengths l can however in principle vary. If the distances d are variable, the lengths l are preferably each at least as large as the largest of the distances d. In preferred embodiments, the distances d are as large as is possible in the design, i.e. in preferred embodiments, the slender roller portions 14 are slender and long enough that the resultant "mesh size" of the roller screen 1 in the peripheral strip 8 is large enough that all the parts of the oversize grain fraction which pass into the peripheral strip 8 and are not conveyed in the transverse direction Y by the rotational movement of the slender roller portions 14 in the region of the peripheral strip 8 can fall downwards between respectively adjacent roller portions 14.

Figure 4:
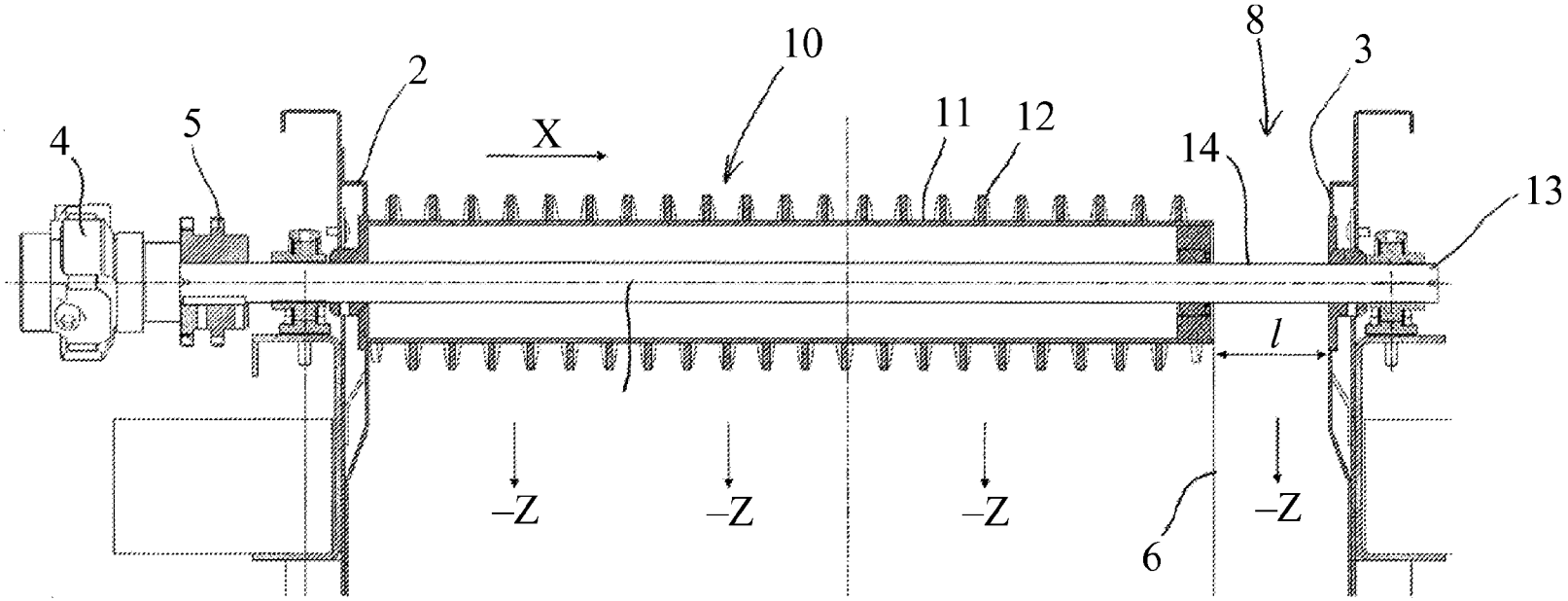
In FIG. 4, the screen device of the first example embodiment, is shown in a section.

FIG. 4 shows the screen device in a section along the rotational axis R of one of the screen rollers 10. The screen rollers 10 each comprise a central shaft 13 which extends through the frame walls 2 and 3 and is rotatably mounted on each of the frame walls 2 and 3 and therefore supported on both sides. The roller bodies 11 of the screen rollers 10 are sleeve-shaped and non-rotationally connected to the shaft 13 of the respective screen roller 10 in a coaxial arrangement with respect to the shaft 13. The shaft 13 of each of the screen rollers 10 extends through the roller body 11 and protrudes beyond the roller body 11 at both ends of the roller body 11, whereby the shaft 13 forms a bearing journal at each of the two ends for the roller body 11 of the same screen roller 10. The winding screen structure 12 is non-rotationally connected to the corresponding roller body 11 and encircles the roller body 11 at its outer circumference as a helical line. The frame walls 2 and 3 enclose the roller screen 1 on the left and right in a seal, such that screening material cannot be conveyed axially past one of the two frame walls 2 and 3, in particular the frame wall 3.

The screen rollers 10 each comprise the described slender roller portion 14 at the ends axially facing the frame wall 3. The continuous shaft 13 forms the slender roller portion 14 directly, as is preferred but merely by way of example, i.e. the roller portion 14 is a portion of the shaft 13. The screen rollers 10 are attenuated in one stage from the comparatively large cross-section of the respective roller body 11 to the comparatively slender roller portion 14, in that the roller bodies 11 each terminate at the distance 1 in front of the frame wall 3 and the shafts 13 each protrude by this distance 1 beyond the axial conveying end of the respective roller body 11 up to the facing frame wall 3 and, for the purpose of rotary-mounting, through the frame wall 3. The screen rollers 10 are mounted on the outside of the frame walls 2 and 3, as viewed from the respective roller body 11. In the example embodiment, they are mounted directly on the frame walls 2 and 3. In modifications, the shafts 13 or other types of bearing journals of the screen rollers 10 can simply merely protrude through the frame walls 2 and 3 and be rotary-mounted on the frame in another way.

The falling direction of the fine grain fraction which falls through the roller screen 1 and, in the peripheral strip 8, the falling direction of the first oversize grain fraction which is conveyed up to and into the peripheral strip 8 is indicated in FIG. 4 by directional arrows −Z.

A partition wall 6 can expediently be arranged beneath the roller screen 1, in order to keep the oversize grain falling down between the slender roller portions 14 in the peripheral strip 8 away from the fine grain separated out beforehand.

Figure 5:
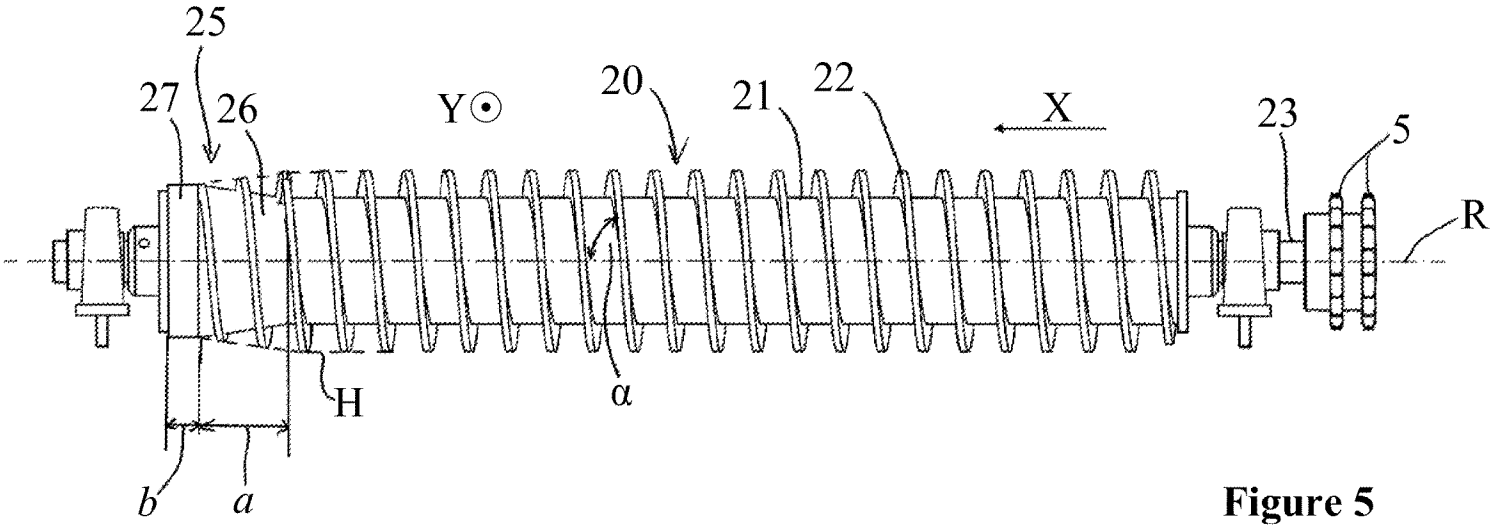
In FIG. 5, a screen roller of a second example embodiment, comprising a widening portion at an axial conveying end, is shown.

FIG. 5 shows a screen roller 20 of a second example embodiment, in a radial view. The screen roller 20 comprises a roller body 21 and a screen structure 22 which protrudes radially from the outer circumference of the roller body 21 and is formed, as in the first example embodiment, as a winding structure which helically encircles the roller body 21, in order to convey the first oversize grain fraction in the axial direction of the rollers X. The winding flanks of the screen structure 22 are inclined at an angle α with respect to the rotational axis R, i.e. exhibit a pitch in accordance with the inclination angle α.

As in the first example embodiment, the roller body 21 can be sleeve-shaped and non-rotationally connected to a shaft 23 which extends axially through the roller body 21. A twin-drive wheel 5 is non-rotationally connected to the screen roller 20 at a drive end of the screen roller 20, as in the first example embodiment.

Unlike the first example embodiment, one end of the roller body 21 comprises an axial widening portion 25 in which the roller body 21 widens uniformly in the axial direction of the rollers X over its entire circumference. The widening is rotationally symmetrical and, as is preferred but merely by way of example, conical. The widening portion 25 forms an end portion of the roller body 21 which is a downward end portion in relation to the axial direction of the rollers X. The roller body 21 is cylindrical, as in the first example embodiment, from its upstream end to the widening portion 25.

In a modified roller screen 1, one or more or preferably all of the screen rollers 10 fitted in the first example embodiment with cylindrical roller bodies 11 is/are each replaced with a screen roller 20. In the roller screen 1 modified in this way, the respective fine grain screen gap exhibits the constant gap width w from the upward end of the roller body 21 to the widening portion 25, wherein in the widening portion 25, the gap width w is reduced in the axial direction of the rollers X to a smaller gap width—gradually, continuously and monotonically in the example embodiment. Because the outer circumference of the roller body 21 increases in the widening portion 25 and the screen gap width is accordingly reduced, the screen roller 20 and the adjacent screen roller or the adjacent two screen rollers together form a flatter depression over the respective screen gap than in the cylindrical roller body portion, wherein the depression flattens out gradually in accordance with the profile of the widening. The parts of the first oversize grain fraction which engage the depression are raised in the region of the widening portion 25; the relevant oversize grain is buoyed upwards, so to speak. The conveying effect exerted by the screen structure 22 in the axial direction of the rollers X is reduced accordingly. Also, the conveying effect exerted on this oversize grain fraction in the circumferential direction Y of the roller body 21 increases. Each of these effects counters the risk of jamming in the peripheral region of the modified roller screen 1 near the frame wall 3 (FIG. 1).

Although the two advantageous effects with regard to reducing the risk of jamming, namely the buoying effect and the stronger conveying effect in the transverse direction Y as viewed over the roller screen 1, are achieved even if not all the screen rollers 10 of the first example embodiment but rather only a sub-group of the screen rollers 10 are replaced with screen rollers 20, for example every second screen roller 10, and although a positive effect is in principle also achieved by replacing even just one screen roller 10, it is preferred if multiple screen rollers 20 are arranged immediately next to each other in the modified roller screen 1 or, even more preferably, if the modified roller screen 1 is formed exclusively or at least predominantly by screen rollers 20.

The modified roller screen 1 which comprises one or more screen rollers 20 instead of (respectively) one of the screen rollers 10 can comprise the peripheral strip 8 of the first example embodiment, even in embodiments in which all or most of the screen rollers 10 are replaced with screen rollers 20, as is preferred. This enables jamming by oversize grain conveyed in the axial direction of the rollers X to be even more reliably countered, in particular in embodiments in which the modified roller screen 1 also still comprises one or more of the screen rollers 10. This is not however required, since the second oversize grain fraction is buoyed upwards in the region of the widening 25, and the conveying effect in the axial direction of the rollers X decreases and the conveying effect in the transverse direction Y increases in the widening portion 25. The roller body 21 can accordingly extend immediately up to the frame wall 3. In the modified roller screen 1, a peripheral strip consisting of widening portions 25 arranged next to each other can replace the peripheral strip 8 of the first example embodiment which, aside from slender roller portions 14 (FIGS. 3 and 4), is vacant.

The roller body 21 can widen in the widening portion 25 from a minimum radial width, preferably a minimum circular diameter, to a maximum radial width, preferably a maximum circular diameter, and terminate immediately upon reaching the maximum width. More preferably, however, the widening portion 25 comprises a first sub-portion 26 and a second sub-portion 27 immediately adjoining it in the axial direction of the rollers X, such as can be seen in FIG. 5. In the example embodiment, the two sub-portions 26 and 27 alone form the entire widening portion 25. The widening from the minimum radial width to the maximum radial width of the widening portion 25 and of the roller body 21 as a whole occurs in the sub-portion 26. The sub-portion 27 is cylindrical and preferably circularly cylindrical. The sub-portion 26 exhibits an axial length a, and the sub-portion 27 exhibits an axial length b. If the widening portion 25 is composed of the two sub-portions 26 and 27, the overall length of the widening portion 25 therefore corresponds to the sum of the lengths a and b. The sub-portion 26 is preferably longer than the sub-portion 27 in order to distribute the widening over a correspondingly large length a and avoid an abrupt transition. The length a is preferably at least 1.5 times, even more preferably at least two times larger than the length b. Since the cylindrical or at least substantially cylindrical sub-portion 27 serves the purpose of exerting a conveying effect in the transverse direction Y on the oversize grain fraction conveyed up to and into the sub-portion 27, namely due to circumferential contact, the sub-portion 27 should however on the other hand exhibit a length b which is sufficient for this purpose. It is advantageous if the length b accounts for at least a tenth of the length of the widening portion 25 or an eighth of the length a. The length b is preferably at least an eighth of the length of the widening portion 25 and/or at least a sixth of the length a.

In order to reduce the conveying effect in the axial direction of the rollers X in the region of the widening portion 25, the screen structure 22 can terminate in front of or at the widening portion 25. More preferably, however, the screen structure 22 extends into the widening portion 25—in the second example embodiment, into the sub-portion 26—and terminates a short distance in front of the downward end of the widening portion 25. The screen structure 22 preferably extends only up to the sub-portion 27 at most, which is advantageously free of any structures which convey in the axial direction of the rollers.

The screen structure 22 can flatten out in the widening portion 25. An imaginary virtual envelope H placed against the outer circumference of the screen structure 22 is shown by a broken line in FIG. 5. The envelope H, which can in particular be cylindrical over the entire axial length of the roller body 21 up to the vicinity of the widening portion 25 or preferably up to the widening portion 25, tapers in the widening portion 25 due to the screen structure 22 flattening out, preferably uniformly over the entire circumference of the roller body 21.

Figure 6:
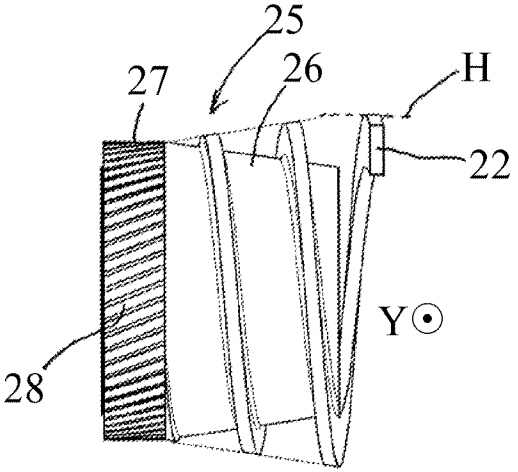
In FIG. 6, a widening portion comprising a transverse and reverse conveying structure is shown.

FIG. 6 shows a modified widening portion 25 which can replace the widening portion 25 shown in FIG. 5. The modified widening portion 25 comprises a transverse conveying structure 28 on the outer circumference of its sub-portion 27 which forms the end of the roller body 21, in order to further intensify the conveying effect in the transverse direction Y. The transverse conveying structure 28 can be formed as surface structuring, for example knurling or fluting, or a circumferentially extending outer denticulation or ribbing, which is flat as compared to the screen structure 22, i.e. radially short of the screen structure 22 of at least the cylindrical roller body portion. The outer denticulation or ribbing can be formed as a linear denticulation or ribbing comprising axial ribs or, in developments such as is shown in FIG. 6, as an oblique denticulation or with teeth or ribs which extend at some other inclination in relation to the rotational axis R and/or axial direction of the rollers X. If the teeth or ribs extend at an inclination with respect to the axial direction of the rollers X, the screen roller 20 also exerts a conveying effect counter to the axial direction of the rollers X in the sub-portion 27 and thus more reliably keeps the oversize grain away from the frame wall 3 or reduces a pressure which may be exerted by the oversize grain on the frame wall 3 in the axial direction of the rollers X.

Wherever differences between the screen roller 20 and the screen roller 10 of the first example embodiment are not described or are not apparent from FIGS. 5 and 6, the screen roller 20 of the second example embodiment can correspond to the screen roller 10 of the first example embodiment, such that reference is additionally made to the statements regarding the first example embodiment.

Figure 7:
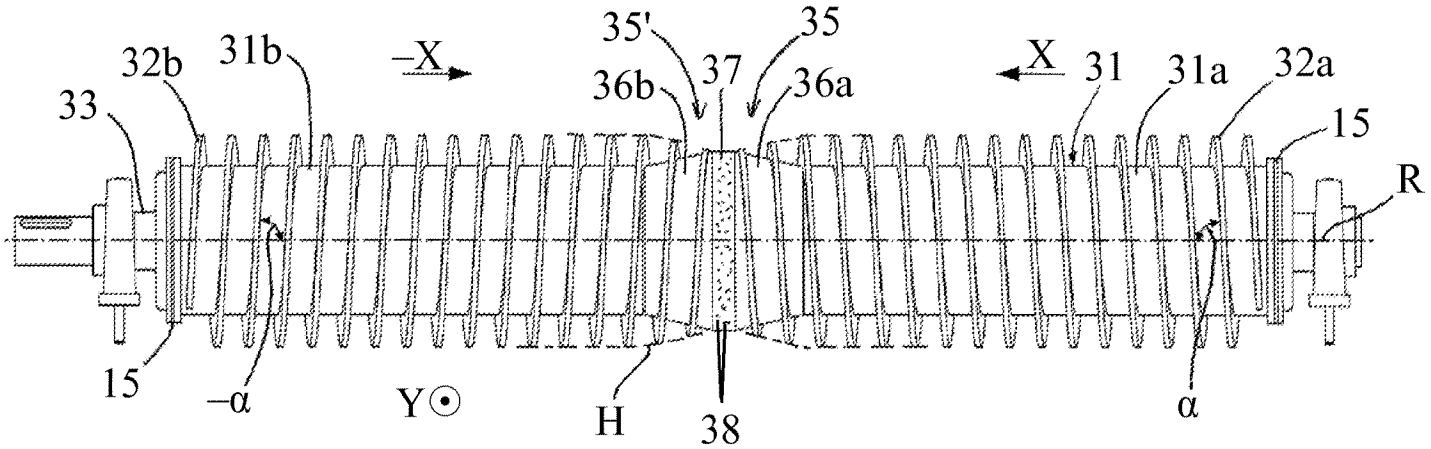
In FIG. 7, a screen roller of a third example embodiment, comprising two widening portions as a middle roller portion, is shown.

FIG. 7 shows a screen roller 30 of a third example embodiment, in a radial view. The screen roller 30 comprises a roller body 31 which comprises, in succession in the axial direction of the rollers X, an upward roller body portion 31*a*, a widening portion 35, an additional widening portion 35' and a downward roller body portion 31*b*. The widening portion 35 directly adjoins the roller body portion 31*a*, the additional widening portion 35' directly adjoins the widening portion 35, and the roller body portion 31*b* directly adjoins the additional widening portion 35'. The roller body portions 31*a* and 31*b* are axially outer roller body portions and form the two ends of the roller body 31. The roller body portions 31*a* and 31*b* can in particular each exhibit a cylindrical outer circumference over their entire length. A shaft 33 extends through the roller body 31 and serves as a bearing journal for mounting the screen roller 30 on both sides, as in the other example embodiments. The shaft 33 protrudes beyond the roller body 31 on both sides, in order to form a rotary bearing point with the frame, for example the frame walls 2 and 3, on each of the two sides of the screen roller 30, as in the other example embodiments. The roller body 31 can however in principle also comprise other types of roller journals for rotary-mounting.

The screen structure 32, which in the third example embodiment is also a winding structure, comprises a first screen structure portion 32*a* which extends in a winding shape in the first roller body portion 31*a*, over its entire axial length as is preferred, and a second screen structure portion 32*b* which extends in a winding shape in the second roller body portion 31*b*, preferably over its entire axial length. An inclination angle α and therefore a pitch of the helical or winding screen structure 32 is selected such that the upward screen structure portion 32*a* exerts a conveying effect in the axial direction of the rollers X on the oversize grain. The helical line of the downward screen structure portion 32*b* extends in the opposite direction to that of the screen structure portion 32*a*. The inclination angle α and/or the pitch of the screen structure portion 32*b* can be as large, in terms of magnitude, as the inclination angle α of the screen structure portion 32*a*, but exhibit a negative polarity accordingly. The inclination angles of the two portions 32*a* and 32*b* can however in principle also differ in terms of their magnitude as well as their polarity. Because the screen structure portions 32*a* and 32*b* extend in opposite directions, the screen roller 30 exerts a conveying effect in the axial direction of the rollers X on the oversize grain in the roller body portion 31*a* and a conveying effect counter to the axial direction of the rollers X, i.e. in the −X direction, on oversize grain situated in the roller body portion 31*b*, when it is rotary-driven.

The widening portions 35 and 35' form a contiguous widening portion 35, 35' axially between the roller body portions 31*a* and 31*b*. In the widening portion 35, the roller body 31 widens in the axial direction of the rollers X from the radial width of the roller body portion 31*a* to a maximum radial width. In the additional widening portion 35', the roller body 31 widens counter to the axial direction of the rollers X from the radial width of the roller body portion 31*b*, again to a maximum radial width. The maximum radial width of the widening portion 35 and the maximum radial width of the additional widening portion 35' are identical, as is preferred, but can in principle also be different.

The cylindrical roller body portions 31*a* and 31*b* exhibit the same radial width; in principle, however, the radial widths of the roller body portions 31*a* and 31*b* can differ from each other. In the example embodiment, the roller body portions 31*a* and 31*b* exhibit the same length and/or the widening portions 35 and 35' exhibit the same length. The roller body portions 31*a* and 31*b* can however in principle differ from each other in terms of their length, and/or the widening portions 35 and 35' can differ from each other in terms of their length. In the third example embodiment, the uniform screen roller body 31 is however symmetrical in relation to a plane of symmetry which extends perpendicular to the rotary axis R between the widening portions 35 and 35'. Because the screen structures 32*a* and 32*b* extend in opposite directions, the screen structure 32 composed of the two screen structures 32*a* and 32*b* is likewise symmetrical with respect to the same plane of symmetry.

The widening portion 35 itself corresponds to the widening portion 25 of the second example embodiment. Aside from the fact that it widens counter to the axial direction of the rollers X, the additional widening portion 35' likewise corresponds to the widening portion 25 of the second example embodiment. Both widening portions 35 and 35' comprise a cylindrical portion in their end regions which face each other axially and in which they directly abut against each other. As in the second example embodiment, the widening portion 35 comprises a first sub-portion 36*a* which widens and, adjoining it, the cylindrical sub-portion 37. This also applies, mirror-inverted, to the additional widening portion 35' which widens in a first sub-portion 36*b* from the width of the roller body portion 31*b* to the maximum radial width and cylindrically extends, at the maximum radial width, in the second sub-portion 37 which it shares with the widening portion 35.

An imaginary virtual envelope H placed against the protruding screen structure 32 is again indicated for the screen roller 30. The envelope H is cylindrical in the roller body portion 31*a*, narrows in the region of the widening portion 35 to the sub-portion 37, then widens mirror-symmetrically in the additional widening portion 35' to the width of the screen structure portion 32*b* and is again cylindrical over the length of the roller body portion 31*b*.

In order to relieve the protruding screen structure 32 in the event of jamming in the axial direction of the rollers X, the screen structure 32 can be arranged such that it can be axially moved to a minor extent. As is preferred, but merely by way of example, the axial mobility of the screen structure 32 is achieved by arranging the roller body 31 such that it can be axially moved. The roller body 31 is mounted on the shaft 33 such that it axially floats. The axially floating arrangement is realized by means of elastic elements 15, one of which is arranged on the left-hand end-face of the roller body 31 and one of which is arranged on the right-hand end-face of the roller body 31. The elastic elements 15 can in particular be elastomer elements or natural rubber elements. They are expediently annular in accordance with the sleeve shape of the roller body 31. Due to their elasticity, they enable the roller body 31 and the screen structure 32 which is immovably connected to it to yield elastically in and counter to the axial direction of the rollers X in the millimeter range, for example by 1 to 3 mm at most. The elastic elements 15 constantly force the deflected roller body 31 back towards an axial position corresponding to the relieved state by means of an elastic restoring force.

The roller screen 1 of the first example embodiment can be modified by replacing one or more or preferably all of the screen rollers 10 with (respectively) a screen roller 30. The statements made regarding the second example embodiment apply in this respect. During sorting operations using the modified roller screen 1, oversize grain is conveyed in the axial direction of the rollers X to the widening portion 35 in the region of each screen roller 30 in the roller body portion 31*a*, and oversize grain is conveyed counter to the axial direction of the rollers, in the direction −X, to the additional widening portion 35' in the region of each screen roller 30 in the roller body portion 31*b*. In the contiguous widening portion 35, 35', the oversize grain experiences an intensified conveying effect in the transverse direction Y. The risk of jamming in a peripheral region near a frame wall, such as for example the frame wall 3, is countered in a particularly effective way.

Another advantage of the screen rollers 20 and 30 and in particular the screen roller 30 is that a peripheral strip 8 (FIGS. 1, 3 and 4), which cannot be used for sorting purposes, can be omitted. A screen device comprising screen rollers 20 and/or screen rollers 30 can be shorter in the axial direction of the rollers X while still retaining the same screening quality. Alternatively, the separating precision of the roller screen 1 can be improved while still retaining the same breadth of the screen device, and/or the throughput can be increased, since the effective surface of the roller screen 1 can be increased while still retaining the same overall length in the transverse direction Y. Also, oversize grain does not have to be transported away below the roller screen.

Figure 8:
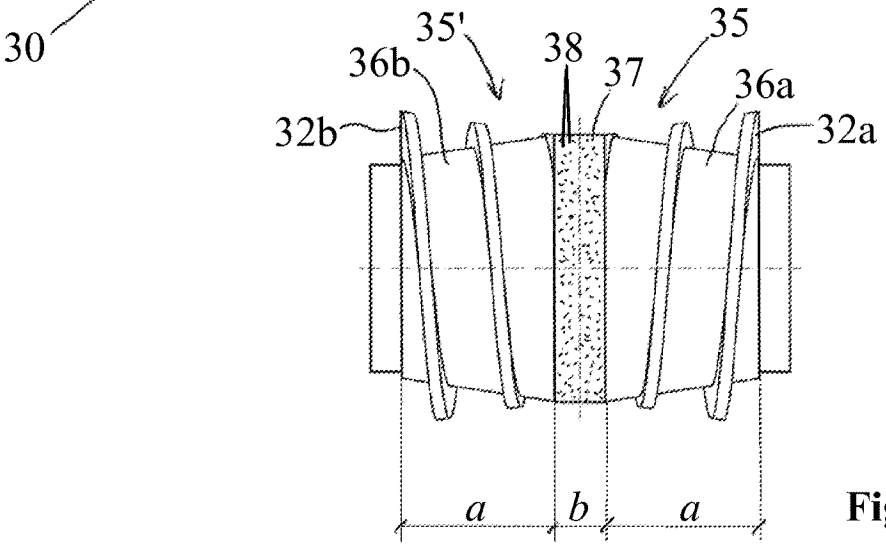
In FIG. 8, two widening portions, comprising a transverse conveying structure, for a middle roller portion, are shown; and In FIG. 9, multiple screen rollers of the third example embodiment, arranged next to each other, are shown in a plan view.

FIG. 8 shows just the contiguous widening portion 35, 35' of the screen roller 30. The axial lengths a of the sub-portions 36*a* and 36*b* are identical, but can in principle also differ from each other. The sub-portion 37 connects the sub-portions 36*a* and 36*b* and exhibits the length b. It is circularly cylindrical, as is preferred but merely by way of example. The roller body 31 can be smooth over its entire exterior in the widening portion 35, 35'. It can also comprise a transverse conveying structure in the widening portion 35, 35'. If provided, the transverse conveying structure can in particular be provided in the sub-portion 37 and preferably only in the sub-portion 37. The roller body 31 can thus comprise a transverse conveying structure 38 in the form of surface structuring, such as for example knurling or fluting, or a more prominently shaped outer denticulation or ribbing on an outer circumferential surface in the widening portion 35, 35', such as can be seen in FIG. 8, in order to intensify the transverse conveying effect. A transverse and reverse conveying structure can also be formed in the sub-portion 37. With regard to an optional transverse and/or reverse conveying structure and the widening portions 35 and 35', reference is made to the statements regarding the second example embodiment, i.e. the screen roller 20. Wherever differences between the screen roller 30 and the screen rollers 10 of the first example embodiment and/or the screen roller 20 of the second example embodiment are not described or are not apparent from FIGS. 7 and 8, the screen roller 30 of the third example embodiment can be embodied in the same way as one of the screen rollers 10 of the first example embodiment and/or the screen roller 20 of the second example embodiment, such that reference is made to the respective embodiments.

Figure 9:
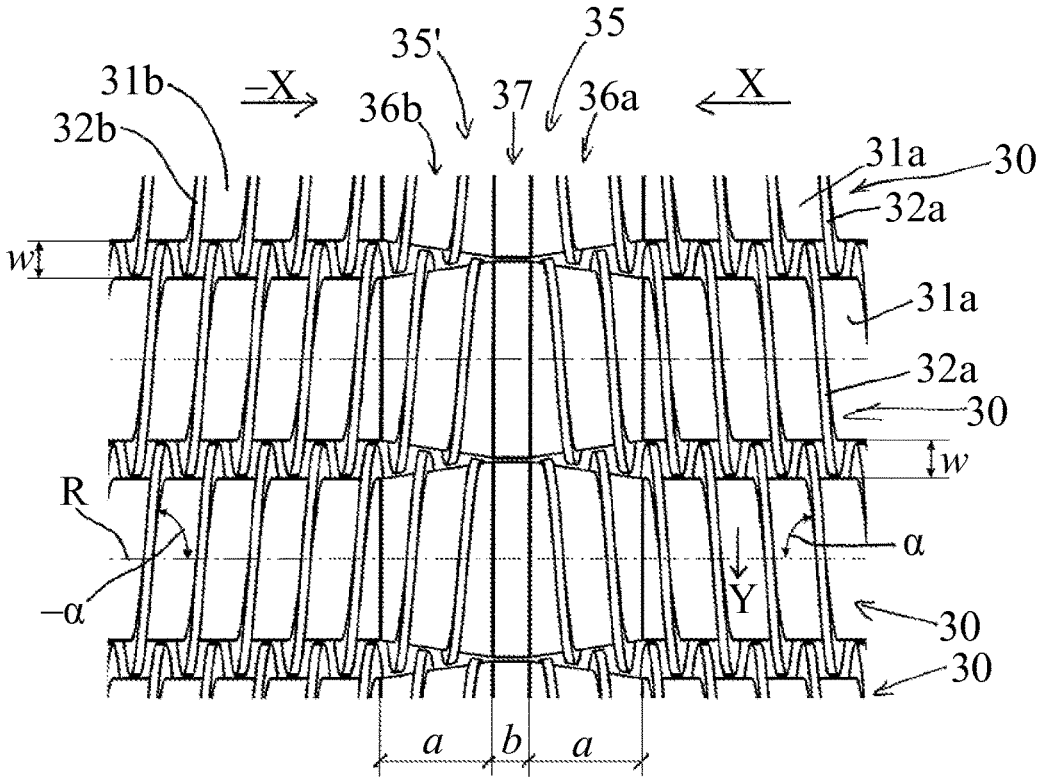

FIG. 9 shows a plan view of a detail of a modified roller screen which is formed from screen rollers 30 of the third example embodiment or at least comprises a screen region comprising multiple screen rollers 30 arranged next to each other. As already described, the screen rollers 30 each comprise the contiguous widening portion 35, 35' in an axially middle roller portion, such that oversize grain is conveyed in the direction X and −X from a right-hand outer roller screen strip and a left-hand outer roller screen strip to the respectively assigned widening portion 35 and 35'. Because the respective screen roller 30 widens on both sides in the contiguous widening portion 35, 35', the gap width w of the fine grain screen gaps respectively formed between adjacent screen rollers 30 is reduced in the contiguous widening portion 35, 35'. The relevant oversize grain is buoyed upwards in the contiguous widening portion 35, 35' and experiences an increasing conveying effect in the transverse conveying direction Y as it is buoyed upwards. For the sake of completeness, it may be remarked that in many applications, batches of screening material comprise an oversize grain fraction which by its very nature is also conveyed substantially to the left and right of the contiguous widening portion 35, 35', substantially in the transverse conveying direction Y only, i.e. is not conveyed to any practically relevant extent in or counter to the axial direction of the rollers X. This oversize grain fraction is substantially conveyed only in the roller screen strips to the left and right of the contiguous widening portion 35, 35', in the circumferential direction and/or transverse conveying direction Y, while the oversize grain fraction which is substantially conveyed axially is conveyed in the transverse direction Y in the middle roller screen strip by the widening portions 35 and 35' which are consecutive, preferably immediately consecutive, in the transverse direction Y.

REFERENCE SIGNS

1 roller screen
2 frame wall
3 frame wall
4 coupling
5 drive wheel
6 partition wall
7 introducing region
8 peripheral strip

9 output region
10 screen roller
11 roller body
12 protruding screen structure
13 shaft
14 slender roller portion
15 elastic element
16 -
17 -
18 -
19—
20 screen roller
21 roller body
22 protruding screen structure
23 shaft
24 -
25 widening portion
26 sub-portion
27 sub-portion
28 transverse conveying structure, transverse and reverse conveying structure
29 -
30 screen roller
31 roller body
31*a* roller body portion
31*b* roller body portion
32 protruding screen structure
32*a* screen structure portion
32*b* screen structure portion
33 shaft
34 -
35 widening portion
35' widening portion
36*a* sub-portion
36*b* sub-portion
37 sub-portion
38 transverse and/or reverse conveying structure
R rotational axis
X axial direction of the rollers
Y transverse direction
Z vertical direction
a length of first sub-portion
b length of second sub-portion
d distance
l breadth of the peripheral strip
w gap width
α inclination angle

What is claimed is:

1. A screen device for sorting screening material into one or more fine grain fractions and one or more oversize grain fractions, the screen device comprising:

a frame; and a roller screen comprising screen rollers which are arranged, such that they can be rotary-driven about a roller axis each, next to each other and which are supported on the frame and which each comprise a roller body and one or more screen structures which protrude radially relative to the roller body, wherein there is a fine grain screen gap between the roller bodies of respectively adjacent screen rollers, through which a fine grain fraction falls, while an oversize grain fraction is conveyed on the roller screen in the axial direction of the rollers when the screen rollers are rotary-driven, wherein the roller body of at least one of the screen rollers widens radially in the axial direction of the rollers in an axial widening portion, and the width of the fine grain screen gap which the widening roller body forms with the roller body of an adjacent screen roller decreases in the axial direction of the rollers along the widening portion, wherein the one or more screen structures of the respectively adjacent screen rollers interlock as viewed in a plan view onto the roller screen.

2. The screen device according to claim 1, wherein a virtual envelope which is placed against the outer circumference of the one or more screen structures of the at least one screen roller comprising the widening portion tapers in the axial direction of the rollers along the widening portion.

3. The screen device according to claim 1, wherein the widening portion of the screen roller further comprises one or more screen structures which protrude radially from the roller body.

4. The screen device according to claim 1, wherein the widening portion widens to a maximum width gradually in the axial direction of the rollers in a first sub-portion and, in a second sub-portion which adjoins the first sub-portion in the axial direction of the rollers, is at least substantially cylindrical and preferably exhibits the maximum width.

5. The screen device according to claim 1, wherein the widening portion widens in the axial direction of the rollers in a first sub-portion and, in a second sub-portion which adjoins the first sub-portion in the axial direction of the rollers, exhibits a maximum width and is at least substantially cylindrical, and wherein the one or more protruding screen structures extend(s) in the axial direction of the rollers up to the second sub-portion at most and preferably into the first sub-portion.

6. The screen device according to claim 1, wherein the widening portion of the roller body comprises a transverse and/or reverse conveying structure on its outer circumference in order to exert a conveying effect, transverse to the axial direction of the rollers and/or counter to the axial direction of the rollers, on oversize grain conveyed into the widening portion.

7. The screen device according to claim 6, wherein the transverse and/or reverse conveying structure is a toothed or ribbed structure comprising teeth or ribs which are axially linear or extend at an inclination with respect to the axial direction of the rollers.

8. The screen device according to claim 1, wherein the widening portion of the roller body widens in a continuously differentiable way over a length of at least several centimeters.

9. The screen device according to claim 1, wherein the widening portion of the roller body widens conically, in the shape of a trumpet or in the shape of a bell, over a length of at least several centimeters.

10. The screen device according to claim 1, wherein the one or more screen structures exhibit an inclination of more than 0° and less than 90° with respect to the axial direction of the rollers in a plan view onto the roller screen, in order to convey at least some of the oversize grain fraction in the axial direction of the rollers when the screen rollers are rotary-driven.

11. The screen device according to claim 1, wherein the roller body which comprises the widening portion can be axially moved.

12. The screen device according to claim 1, wherein an axially elastic element is arranged on at least one of the side-faces of the roller body which comprises the widening portion, and the roller body can be axially moved, counter to the restoring force of the elastic element.

13. The screen device according to claim 1, wherein the screen rollers are rotatably mounted on the frame at both axial ends.

14. The screen device according to claim 1, wherein a frame wall protrudes beyond an upper side of the roller screen at an end of the screen rollers which is a downward end in the axial direction of the rollers, and at least some of the roller bodies are attenuated at the ends facing the frame wall or terminate at an axial distance in front of the frame wall, such that the screen rollers each comprise a slender roller portion at the ends facing the frame wall, and the clear distance between respectively adjacent slender roller portions is at least twice as large as a maximum width of the fine grain screen gap between adjacent roller bodies, such that the slender roller portions form a peripheral strip which extends transverse to the axial direction of the rollers and adjoins the frame wall and in which oversize grain conveyed up to and into the peripheral strip can fall down between the screen rollers.

15. The screen device according to claim 1, wherein the roller body comprises an additional widening portion and widens in the additional widening portion, either likewise in the axial direction of the rollers or preferably counter to the axial direction of the rollers.

16. The screen device according to the preceding claim, wherein the widening portions collectively form a contiguous widening portion in which the roller body widens in the axial direction of the rollers and then tapers again.

17. The screen device according to claim 1, wherein the widening portion forms an axial conveying end of the at least one screen roller and preferably exhibits a maximum width at the conveying end.

18. The screen device according to claim 1, wherein the roller body comprises a roller body portion which is an upward roller body portion in relation to the axial direction of the rollers, a roller body portion which is a downward roller body portion in relation to the axial direction of the rollers, and the widening portion axially between the upward and downward roller body portions.

19. The screen device according to claim 18, wherein the one or more protruding screen structures of the at least one screen roller comprising the widening portion exhibit an inclination of more than 0° and less than 90° with respect to the axial direction of the rollers in a plan view onto the roller screen, and the inclination is positive in the upward roller body portion up to or up to and into the widening portion and negative in the downward roller body portion up to the widening portion at most, in order to convey at least a first portion of the oversize grain fraction in the axial direction of the rollers and at least a second portion of the oversize grain fraction counter to the axial direction of the rollers and to remove it transverse to the axial direction of the rollers in the region of the widening portion.

20. The screen device according to claim 1, wherein the roller screen comprises multiple screen rollers which widen radially.

21. The screen device according to claim 1, wherein at least every second screen roller in a plan view onto the roller screen respectively widens radially.

22. The screen device according to claim 1, wherein two or more screen rollers of the roller screen which are arranged immediately next to each other in a plan view respectively widen radially, and the widening portions of adjacent screen rollers are arranged next to each other and widen in the same direction, such that the width of the fine grain screen gap between the adjacent widening portions is reduced from both sides.

23. The screen device according to claim 20, wherein the widening portions of the screen rollers are arranged such that in a plan view onto the roller screen, they collectively form a linear strip of widening portions which is oblique or orthogonal with respect to the axial direction of the rollers.

24. The screen device according to claim 23, wherein the widening portions of the screen rollers are arranged next to each other and level in the axial direction of the rollers.

25. A screen device for sorting screening material into one or more fine grain fractions and one or more oversize grain fractions, the screen device comprising:

a frame comprising a frame wall; and a roller screen comprising screen rollers which are arranged, such that they can be rotary-driven about a roller axis each, next to each other and which are supported on the frame and which each comprise a roller body and one or more screen structures which protrude radially relative to the roller body, such that there is a fine grain screen gap between the roller bodies of respectively adjacent screen rollers, through which a fine grain fraction falls, while at least one oversize grain fraction is conveyed on the roller screen in the axial direction of the rollers towards the frame wall when the screen rollers are rotary-driven, wherein the screen rollers are rotatably mounted on the frame at both axial ends, and the frame wall limits the roller screen at an end which is a downward end in relation to the axial direction of the rollers, and protrudes beyond an upper side of the roller screen, such that oversize grain cannot be conveyed over the frame wall in the axial direction of the rollers, and wherein at least some of the roller bodies are attenuated at the upward ends or terminate at an axial distance in front of the frame wall, such that the screen rollers each comprise a slender roller portion at the ends facing the frame wall, and the clear distance between respectively adjacent slender roller portions is at least twice as large as a maximum width of the fine grain screen gap between adjacent roller bodies, such that the slender roller portions form a peripheral strip which extends transverse to the axial direction of the rollers and adjoins the frame wall and in which oversize grain conveyed up to and into the peripheral strip can fall down between the screen rollers.

26. A screen roller for a screen device for sorting screening material into a fine grain fraction and an oversize grain fraction, the screen roller comprising:

a roller body comprising an outer roller body circumference;

a bearing journal for rotary-mounting the roller body about a roller axis;

and one or more screen structures which is/are connected to the roller body, such that torque is transmitted, and protrude(s) radially from the roller body circumference and is/are formed by a winding structure which helically encircles the roller body circumference or by multiple screen discs which are axially spaced from each other, wherein the roller body circumference widens radially in the axial direction of the rollers in an axial widening portion, wherein a virtual envelope which is placed against the outer circumference of the one or more screen structures of the at least one screen roller comprising the widening portion tapers in the axial direction of the rollers along the widening portion.

27. A screen roller for a screen device for sorting screening material into a fine grain fraction and an oversize grain fraction, the screen roller comprising:

a roller body comprising an outer roller body circumference;

a bearing journal for rotary-mounting the roller body about a roller axis;

and one or more screen structures which is/are connected to the roller body, such that torque is transmitted, and protrude(s) radially from the roller body circumference and is/are formed by a winding structure which helically encircles the roller body circumference or by multiple screen discs which are axially spaced from each other, wherein the roller body circumference widens radially in the axial direction of the rollers in an axial widening portion, wherein the widening portion of the roller body comprises a transverse and/or reverse conveying structure on its outer circumference in order to exert a conveying effect, transverse to the axial direction of the rollers and/or counter to the axial direction of the rollers, on oversize grain conveyed into the widening portion.

* * * * *